US006085421A

United States Patent [19]

Jorna et al.

[11] Patent Number: 6,085,421

[45] Date of Patent: Jul. 11, 2000

[54] SHAVING APPARATUS

[75] Inventors: Cornelis J. Jorna; Fokke R. Voorhorst, both of Drachten, Netherlands

[73] Assignee: U.S. Philips Corporation, New York, N.Y.

[21] Appl. No.: 09/276,167

[22] Filed: Mar. 25, 1999

[30] Foreign Application Priority Data

Mar. 27, 1998 [EP] European Pat. Off. ..... 98200965

[51] Int. Cl.[7] ..... B26B 19/14

[52] U.S. Cl. ..... 30/43.6; 30/346.51

[58] Field of Search ..... 30/43.6, 41.6, 30/43.5, 43.4, 346.51

[56] References Cited

U.S. PATENT DOCUMENTS

| | | | |
|---|---|---|---|
| 2,280,052 | 4/1942 | Bahr | 30/43 |
| 2,494,464 | 1/1950 | Vivie et al. | 30/43.6 |
| 3,116,551 | 1/1964 | Anton | 30/43.6 |
| 3,191,297 | 6/1965 | Starre et al. | 30/43.6 |
| 5,544,414 | 8/1996 | Dekker et al. | 30/43.6 |

FOREIGN PATENT DOCUMENTS

| | | | |
|---|---|---|---|
| 948393 | 8/1956 | Germany | 30/41.6 |
| 97/03781 | 2/1997 | WIPO | B23H 3/02 |

OTHER PUBLICATIONS

Translation of German Document No. 948,393, Nov. 1941.

*Primary Examiner*—M. Rachuba
*Assistant Examiner*—Dominic Troiano
*Attorney, Agent, or Firm*—Ernestine C. Bartlett

[57] ABSTRACT

A shaving apparatus having an external cutting member and an internal cutting member, which is rotationally drivable with respect to said external cutting member, which external cutting member is formed with a circular groove having a bottom wall and an upright inner and outer wall, the bottom wall and the outer wall having at least a plurality of slit-shaped hair-entry apertures oriented substantially radially, the inner wall and a small part of the adjoining bottom wall further forming an uninterrupted guard wall which precludes the entry of hairs. To improve the hair-catching performance the guard wall has grooves which are oriented substantially radially and which are disposed in line with the slit-shaped hair-entry apertures.

6 Claims, 3 Drawing Sheets

SHAVING APPARATUS

BACKGROUND OF THE INVENTION

The invention relates to a shaving apparatus having at least one circular cutting unit which comprises an external cutting member and an internal cutting member, which is rotationally drivable with respect to said external cutting member, which internal cutting member has cutting elements having cutting edges, which external cutting member is formed with a circular groove having a bottom wall and an upright inner and outer wall, the bottom wall and the outer wall having a plurality of slit-shaped hair-entry apertures oriented substantially radially, between which apertures lamellae are formed, which lamellae have counter-cutting edges for cooperation with the cutting edges of the cutting elements of the internal cutting member in order to sever hairs, the inner wall and a small part of the adjoining bottom wall forming an uninterrupted guard wall which precludes the entry of hairs.

Such a shaving apparatus is known from U.S. Pat. No. 2,280,052. The guard wall has a number of advantages such as a better support for the cutting elements, as a result of which the cutting edges remain sharp for a longer time, and a more robust construction, as a result of which the lamellae are less vulnerable. Moreover, it allows the hair-entry aperture in the outer wall of the groove to be deeper, as a result of which longer hairs are caught more effectively. A disadvantage of this guard wall in said known shaving apparatus is that during shaving hairs which come from the center of the cutting member are caught less satisfactorily because such hairs are very likely to be flattened and to be oriented transversely or at least obliquely across the hair-entry apertures and, as a consequence, are not caught in the hair-entry apertures.

SUMMARY OF THE INVENTION

It is an object of the invention to improve the hair-catching capability of the shaving apparatus of the type defined in the opening paragraph and thereby obtain a better shaving performance.

To this end, the shaving apparatus in accordance with the invention is characterized in that the guard wall has grooves which are oriented substantially radially and which are disposed in line with the slit-shaped hair-entry apertures. Hairs situated within the circular cutting member and caught in the hair-entry apertures from this area under the influence of the movement of the cutting member over the skin, are first guided in the grooves and subsequently enter the hair-entry apertures, which are disposed in line with these grooves. This increases the likelihood that more hairs are caught and are subsequently cut off. Shaving becomes more effective.

It is to be noted that a rotationally drivable cutting member is also meant to be such a cutting member which is drivable with an oscillatory rotation.

BRIEF DESCRIPTION OF THE DRAWINGS

An embodiment of the invention will now be described in more detail, by way of example, with reference to the drawings. In the drawings

DESCRIPTION OF THE PREFERRED EMBODIMENTS

Figure 1:
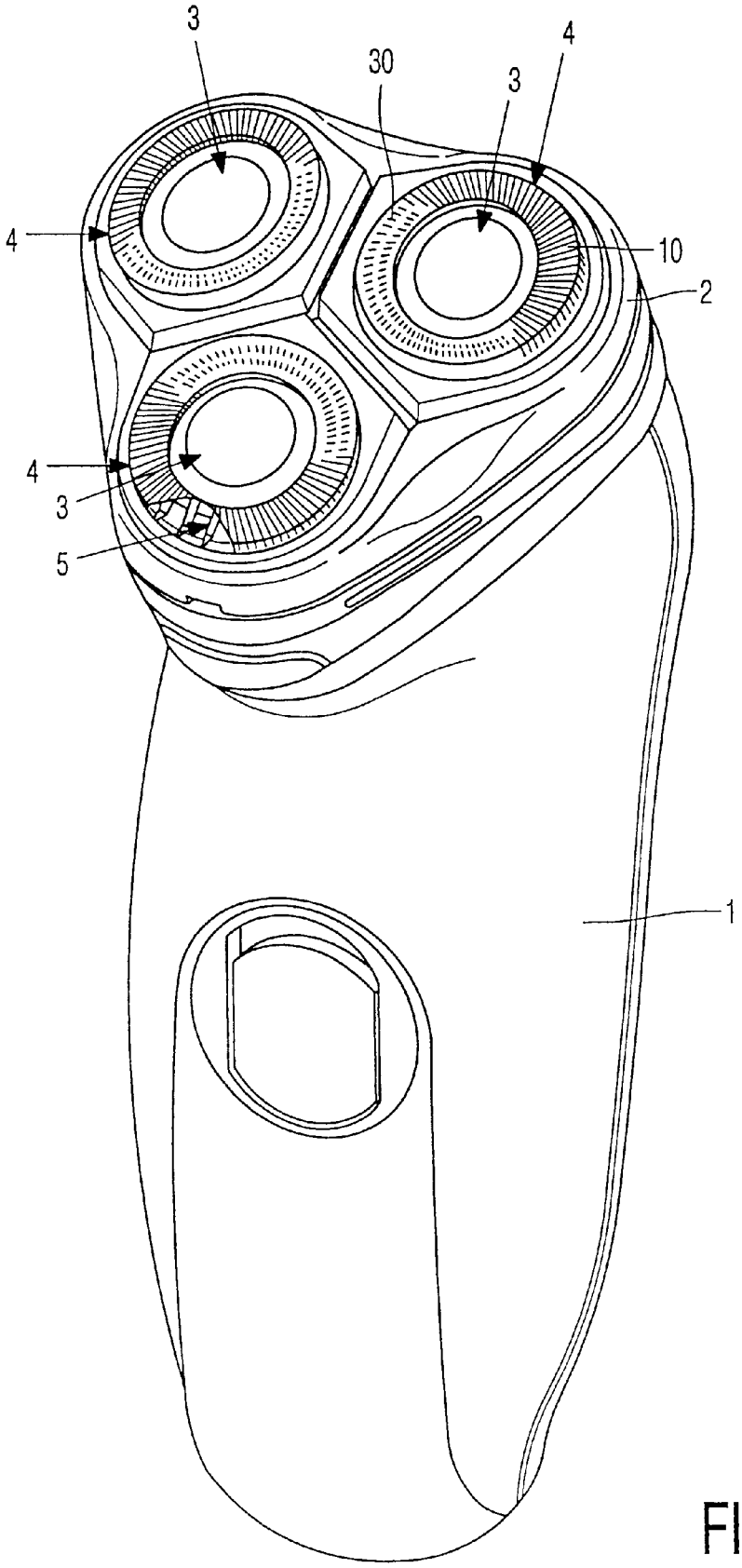
FIG. 1 is a perspective view of a shaving apparatus having three shaving units.

The shaving apparatus shown in FIG. 1 has a housing 1 having a holder 2 which is detachable from the housing or which is pivotable with respect to the housing. The holder holds three cutting units 3, also referred to as shaving heads.

Figure 2:
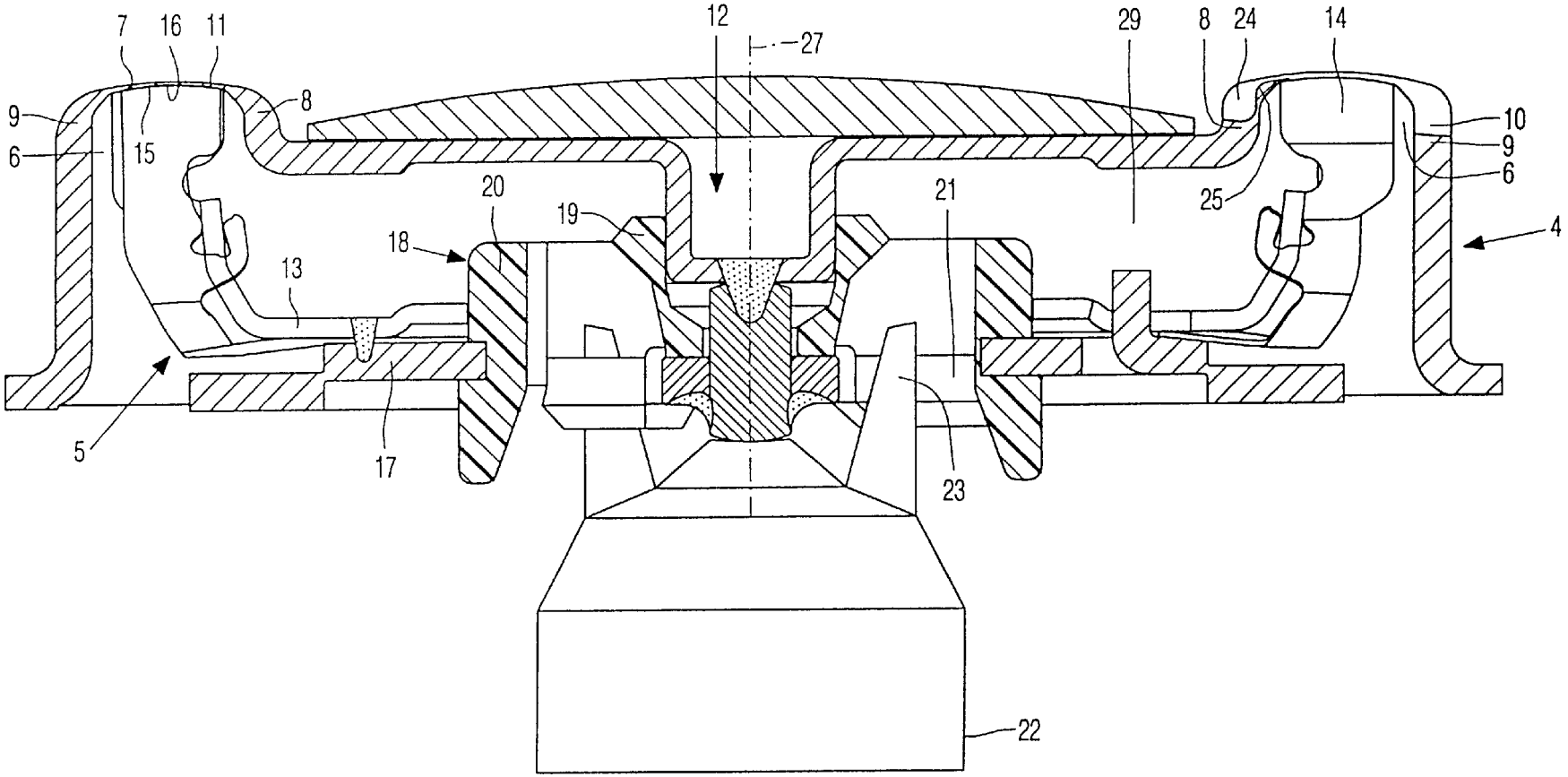
FIG. 2 is a cross-sectional view of one of the three shaving units shown in FIG. 1.

The example of a shaving unit 3 shown in FIG. 2 comprises an external hair cutting member 4 and an internal hair cutting member 5, which is rotationally drivable with respect to said external hair cutting member. The internal hair cutting member is driven by a motor (not shown) accommodated in the housing.

The external cutting member 4, which is shaped as a circular cap, is formed with a circular groove 6. The groove has a bottom wall 7, an upright inner wall 8 and an upright outer wall 9. The bottom wall 7 and the outer wall 9 has a plurality of slit-shaped hairentry apertures 10 oriented substantially radially with respect to the center of the cutting member, between which apertures lamellae 1 extend. The external cutting member may exclusively have such slit-shaped hair-entry apertures but it may alternatively have hair-entry apertures of, for example, two or three different types, on least one of said types being slit-shaped as intended above. In FIG. 1 two types of hair-entry apertures are shown: the afore-mentioned slit-shaped apertures 10 and small round or oval apertures 30. The external cutting member has a central bearing shaft 12, which extends in an axial direction.

The internal cutting member 5 comprises a central portion 13 having cutting elements 14 at its circumference. The ends of these cutting elements have cutting edges 15, which cooperate with counter-cutting edges 16 of the lamellae 11 for severing hairs which project through the hair-entry apertures 10 (also see FIG. 4). The central portion 13 is secured to a plate 17 provided with an annular central coupling member 18. The coupling member is formed by a bearing bush 19 and a surrounding ring 20. The ring is connected to the bearing bush by means of spokes 21. The internal cutting member 5 is rotatable with respect to the external cutting member 4. For this purpose, the bearing bush 19 is journalled on the bearing shaft 12. The internal cutting member 5 is rotated or rotated in an oscillatory fashion with respect to the external cutting member 4 by means of a coupling shaft 22 driven by a motor. For this purpose, the coupling shaft has a plurality of coupling fingers 23 which engage between the spokes 21 of the coupling member 18.

Figure 3:
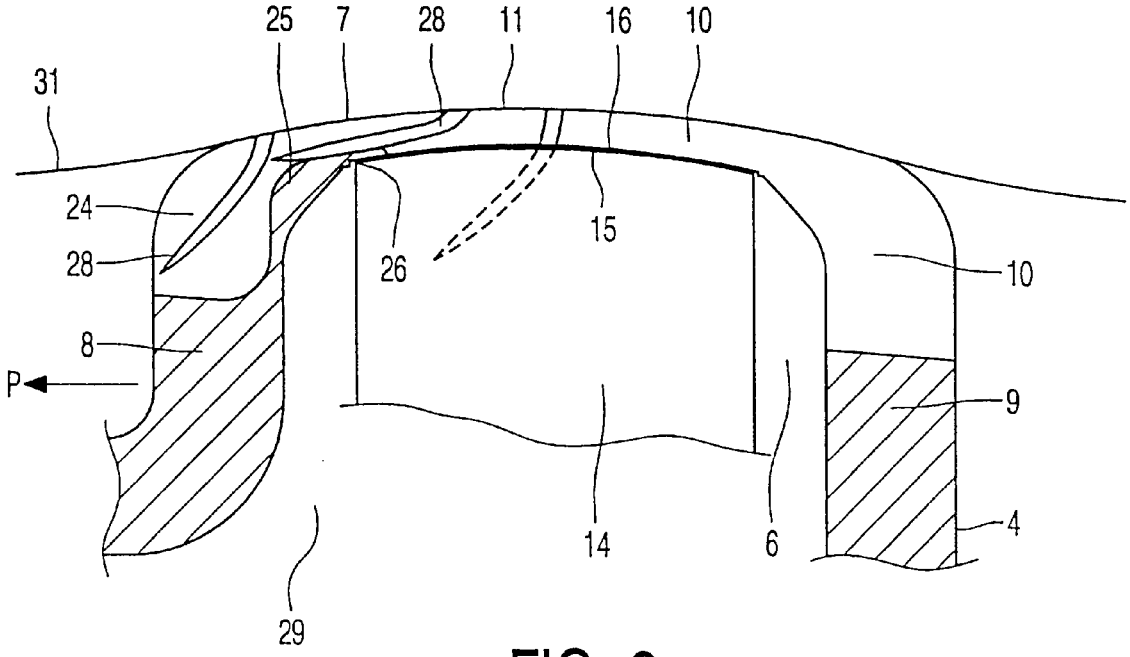
FIG. 3 shows a detail of the cross-sectional view of the shaving unit shown in FIG. 2.

The detail drawing of FIG. 3 shows a cross-sectional view taken across a hairentry aperture. This Figure shows that a groove 24 has been formed in the inner wall 8 and a small part of the bottom wall 7 in such a manner that a wall portion of the inner wall 8 and of said small part of the bottom wall 7 is left. This wall portion, referred to as the guard wall 25, is an uninterrupted circular wall, i.e. it is imperforate. It is disposed substantially opposite the corner point 26 of the cutting edge 15 of the cutting elements 14. The groove 24 is disposed in line with the hair-entry aperture 10. During shaving hairs 28 coming from the center of the cutting member, i.e. from the axis of rotation (the cutting member then in fact moves over the skin 31 in the direction indicated by the arrow P), are guided in the grooves 24 from which they automatically enter the slit-shaped hair-entry apertures 10, through which they subsequently extend and where they are severed by coaction of the cutting edges 15, 16. The grooves 24 thus function as hair guide grooves. An important advantage is that the internal cutting member 5 and the external cutting member 4 now interengage in such a way that an interlocked construction of the cutting unit 3 is obtained. This means that the internal cutting member 5 can no longer be taken out of the external cutting member. The internal cutting member rotates very accurately in the external cutting member. If such an interlocked construction of the cutting unit does not have such a guard wall as described hereinbefore, it has been found that, in practice, longer hairs coming from the center of the cutting member enter the hair collecting chamber 29 via the hair-entry apertures in the upright inner wall 8 and are cut off or torn off at a greater length. These longer hairs can accumulate as a kind of bird's nest around the bearing shaft 12 (see FIG. 2). In the case of such an interlocked construction of a cutting unit such a nest of hairs could not be removed or would be very hard to remove. The guard wall thus enables the use of an interlocked construction for a cutting unit without the aforementioned problem of long hairs.

In the construction shown in FIG. 3 the guard wall 25 has been extended so far inward that the corner point 26 of the cutting edge 15 of the cutting element 14 is also covered. The corner point 26 is the tip of the cutting edge nearest the axis of rotation 27 of the internal cutting member 5. This not only leads to less irritation of the skin but it also provides a better support of the cutting elements.

Figure 4:
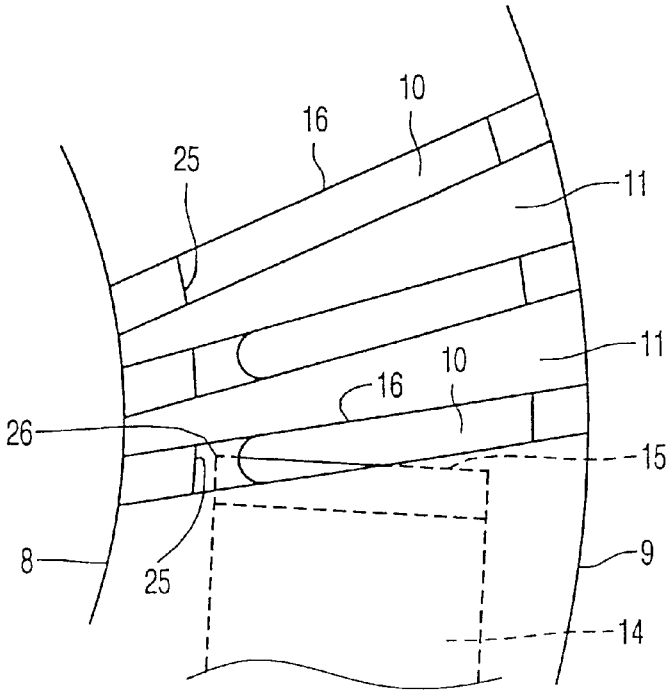
FIG. 4 shows a detail of a plan view of a shaving unit shown in FIG. 3.

FIG. 4 shows a detailed plan view of the location of a cutting element 14 with respect to the hair-entry apertures 1. It can be seen clearly that the corner point 26 of the cutting edge 15 is disposed underneath the guard wall 25.

Forming the slit-shaped hair-entry aperture 10 and the hair guide groove 24 near the guard wall can be effected by means of, for example, an electrochemical process (Electro-Chemical Machining), as is described in WO-A2-97/03781 which corresponds substantially to U.S. Pat. No. 5,833,835 issued Nov. 10, 1998 and commonly assigned herewith.

Although the entry of long hairs coming from the periphery of the cutting member (the cutting member then moves in a direction opposite to that indicated by the arrow P, see FIG. 3) presents considerably less problems as regards the accumulation of hairs, it is obviously also possible to provide a guard wall having grooves for guiding the hairs into the hair-entry apertures at this location.

What is claimed is:

1. A shaving apparatus having at least one circular cutting unit which comprises an external cutting member and an internal cutting member, which is rotationally drivable with respect to said external cutting member, which internal cutting member has cutting elements having cutting edges, which external cutting member is formed with a circular groove having a bottom wall and an upright inner and outer wall, the bottom wall and the outer wall having a plurality of slit-shaped hair-entry apertures oriented substantially radially, between which apertures lamellae are formed, which lamellae have counter-cutting edges for cooperation with the cutting edges of the cutting elements of the internal cutting member in order to sever hairs, the inner wall and a portion of the adjoining bottom wall forming an uninterrupted guard wall which precludes the entry of hairs, wherein the guard wall has grooves which are oriented substantially radially and which are disposed in line with the slit-shaped hair-entry apertures.

2. A shaving apparatus as claimed in claim 1, wherein also the outer wall and a portion of the adjacent bottom wall form a second uninterrupted guard wall which precludes the entry of hairs, said second guard wall also having grooves which are oriented substantially radially and which are disposed in line with the slit-shaped hair-entry apertures.

3. A shaving apparatus as claimed in claim 1, wherein the guard wall covers corner points of the cutting edges.

4. A shaving apparatus as claimed in claim 2, wherein the first guard wall covers corner points of the cutting edges.

5. A shaving apparatus as claimed in claim 2, wherein the second guard wall covers corner points of the cutting edges.

6. A shaving apparatus as claimed in claim 2, wherein the first guard wall and the second guard wall cover corner points of the cutting edges.

* * * * *